US006830409B2

(12) United States Patent
Carlson

(10) Patent No.: US 6,830,409 B2
(45) Date of Patent: Dec. 14, 2004

(54) CONCRETE PLACING AND SCREEDING MACHINE

(76) Inventor: Gregory P. Carlson, 11491 Hillcrest Dr., St. Paul, MN (US) 55110-6181

( * ) Notice: Subject to any disclaimer, the term of this patent is extended or adjusted under 35 U.S.C. 154(b) by 0 days.

(21) Appl. No.: 10/315,729

(22) Filed: Dec. 10, 2002

(65) Prior Publication Data

US 2003/0108390 A1 Jun. 12, 2003

Related U.S. Application Data

(60) Provisional application No. 60/340,942, filed on Dec. 12, 2001.

(51) Int. Cl.[7] ..... E01C 19/22
(52) U.S. Cl. ..... 404/118; 404/84.5
(58) Field of Search ..... 404/101, 113, 404/114, 118, 119, 120, 84.8, 84.2

(56) References Cited

U.S. PATENT DOCUMENTS

| | | | | | |
|---|---|---|---|---|---|
| 3,526,173 | A | * | 9/1970 | Brandstetter et al. | 404/108 |
| 4,314,773 | A | | 2/1982 | Allen | 404/116 |
| 4,466,757 | A | | 8/1984 | Allen | 404/114 |
| 4,648,741 | A | * | 3/1987 | Allen | 404/119 |
| 4,655,633 | A | | 4/1987 | Somero et al. | 404/75 |
| 4,722,638 | A | | 2/1988 | Morrison | 404/119 |
| 4,741,643 | A | * | 5/1988 | Allen | 404/114 |
| 4,822,210 | A | * | 4/1989 | Oury et al. | 404/106 |
| 4,869,618 | A | | 9/1989 | Morrison | 404/118 |
| 4,930,935 | A | | 6/1990 | Quenzi et al. | 404/75 |
| 4,978,246 | A | | 12/1990 | Quenzi et al. | 404/84 |
| 5,234,281 | A | | 8/1993 | Somero et al. | 404/84.5 |
| 5,352,063 | A | * | 10/1994 | Allen et al. | 404/84.1 |
| 5,476,341 | A | * | 12/1995 | Johnson et al. | 404/101 |
| 6,089,787 | A | | 7/2000 | Allen et al. | 404/118 |
| 6,588,976 | B2 | * | 7/2003 | Quenzi et al. | 404/84.8 |

* cited by examiner

*Primary Examiner*—Robert E. Pezzuto
*Assistant Examiner*—Alexandra Pechhold
(74) *Attorney, Agent, or Firm*—Nawrocki, Rooney & Sivertson, P.A.

(57) ABSTRACT

A concrete deposition device includes at least a concrete delivery unit and a leveling element in a single unit. The device can be moved across an edge of a concrete mass under deposition to simultaneously place and level plastic concrete. The device may also include a screed trailing the leveling element to provide additional compacting and control of the top surface of the concrete mass. In a preferred embodiment a carrier translates the deposition device along a predetermined path to provide for improved ease and accuracy in the formation of the concrete mass.

24 Claims, 18 Drawing Sheets

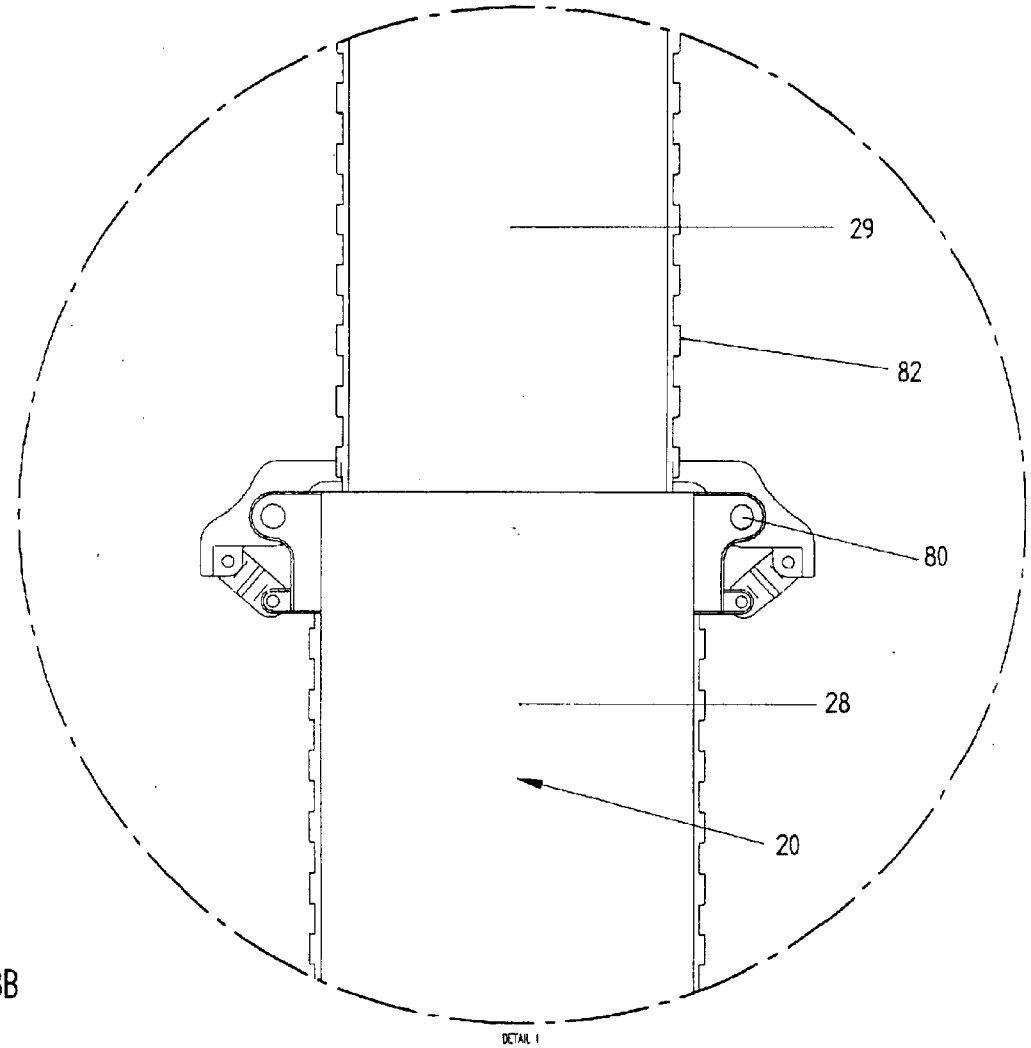
Fig. 3B
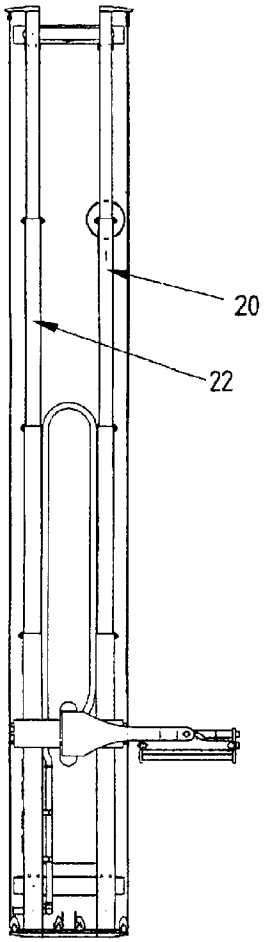

CONCRETE PLACING AND SCREEDING MACHINE

CLAIM OF PRIORITY

I claim priority for this application from my earlier provisional application of the same title filed on Dec. 12, 2001 and having Serial No. 60/340,942.

BACKGROUND

The invention generally relates to equipment used to deposit initially plastic concrete that hardens to form slabs for floors, road surfaces, etc. The term "plastic" in this context refers to concrete that can be poured and shaped, but that will not easily flow or level itself under the force of gravity when pooled as does a true liquid. Concrete is plastic from the time of mixing and for a period thereafter depending on the type and amount of cement powder used, additives that speed or retard the hardening, and the temperature of the plastic concrete.

To use plastic concrete as a building material to construct rigid concrete slabs and other configurations that form floors, decks, roadways, runways, and bridges, the concrete must first be placed, then leveled, and finally screeded to create the final surface geometry and elevation. "Placing" is the initial deposition of the plastic concrete. "Leveling" is the removal, addition, and shifting of placed concrete to create nearly the desired geometry or profile and elevation of the top surface. "Screeding" is a final step performed after leveling that provides the final desired profile and elevation, gives the top surface a smooth texture, compacts the plastic concrete, and removes remaining voids that may affect strength or durability. Screeding is performed by a flat-surfaced screed that is passed across the plastic concrete. Frequently the screed is vibrated during use to compact and remove voids from the plastic concrete.

To construct a concrete floor in a warehouse for instance, the first step is generally to erect forms of a suitable material at the perimeter of the intended area. Next a subsurface of gravel, compacted sand, or other particulate material is deposited and leveled. Frequently, reinforcing bars or mesh is placed above the subsurface but below the intended concrete surface to provide tensile strength for the hardened concrete.

The concrete deposition begins with placing the plastic concrete inside the forms. The process of placing concrete for a project is accomplished in one or more ways. Plastic concrete may be discharged directly from the chute of a concrete mixing truck. It of course may also be mixed at the site. In any case, the mixed, plastic concrete is conveyed to the desired area of the subsurface by means such as wheelbarrow, motorized concrete buggy, or concrete bucket suspended by a crane or forklift over the subsurface. Plastic concrete may also be pumped to the desired location with specialized concrete pumps.

No matter which of these traditional means of placing concrete is used however, the operator of the particular placing means employed controls where and how much concrete is placed. Since the operator is generally proceeding without a precise visual or other reference point showing the amount of concrete required and the amount placed, the predictable result is that the initial elevation and profile of the placed concrete is only a very rough approximation of the desired final elevation and profile.

The next step is leveling, which redistributes the placed, plastic concrete to a close approximation of the desired final distribution and profile. High spots are knocked down and low spots are filled in. Excess concrete is removed and insufficient amounts supplemented. Workers using shovels, rakes, and concrete 'come-alongs' frequently perform the leveling. Alternatively, mechanical means may be employed for this redistribution, including plows, augers, oscillating beams and the like.

The last step of forming the concrete mass is screeding. The screed is moved across the surface of still-plastic concrete to conform the concrete's exposed vertical-facing surface to the desired final profile and elevation. To accomplish this, the screed itself must be precisely controlled as to its elevation, either by riding on carefully set forms or by a continuously and automatically adjusted screed control means responding to an external reference signal, such as a laser beam, GPS signal, etc.

A variety of screed means are commonly employed, including straight beams, trusses, and rollers in single or multiple configurations. Screed means frequently vibrate or oscillate to further smooth and consolidate the concrete surface.

The need during leveling to redistribute or shift concrete after it has been placed and before it can be screeded is a major source of inefficiency in the overall process of concrete flatwork construction. Costs are increased. Delays are incurred. Quality, as reflected by measures of floor flatness and floor level (FF/FL) may suffer, if the redistribution is not accurately completed. And the ultimate strength and durability of the hardened concrete may also be affected.

BRIEF DESCRIPTION OF THE INVENTION

The invention aims to improve the efficiency of traditional means of placing, leveling, and screeding concrete by reducing or eliminating the need to redistribute and shift concrete during the leveling step and then further, by integrating the screeding with the leveling. It accomplishes these ends by using a machine that automates and combines at least the placing and leveling activities. The screeding activity can also easily be included in a preferred embodiment of the invention.

The machine has a placing element that relatively evenly distributes the plastic concrete along an advancing deposition front. The machine includes a leveling element integrated with the placing element. In this machine, leveling occurs immediately after placing in a way that creates an approximate profile and height of the concrete and assures an adequate amount of placed concrete across the deposition front. Excess placed concrete is shifted to subsurface areas not yet having any placed concrete in a way that provides a reasonably accurate elevation and profile for the leveled concrete.

My machine preferably also includes a screeding element. Screeding preferably occurs in an integral step that immediately follows leveling and may be referenced to any convenient surface elevation and geometry control using conventional means. Screeding may even be done manually.

This machine makes possible a process for forming a concrete mass comprising the first step of depositing a first strip of concrete sequentially along a first predetermined path and for a predetermined distance. Then almost immediately a second strip of concrete is deposited immediately adjacent to the first strip of concrete along a second predetermined path and for a predetermined distance. This process then continues depositing of strips of concrete in this manner for a predetermined number of iterations until the desired mass of concrete has been formed. The process forms an advancing front of plastic concrete that advances strip by strip and transversely to the predetermined paths until the entire mass of concrete has been deposited and leveled. Of course, the predetermined paths need not be linear, but can be any desired shape or configuration. However, in many cases the predetermined paths will be straight and approximately parallel to each other.

BRIEF DESCRIPTION OF THE DRAWINGS

FIG. 3B is a detail of a top elevation view of the rack and pawl structure of FIG. 3.

DESCRIPTION OF THE EMBODIMENTS

Figure 1:
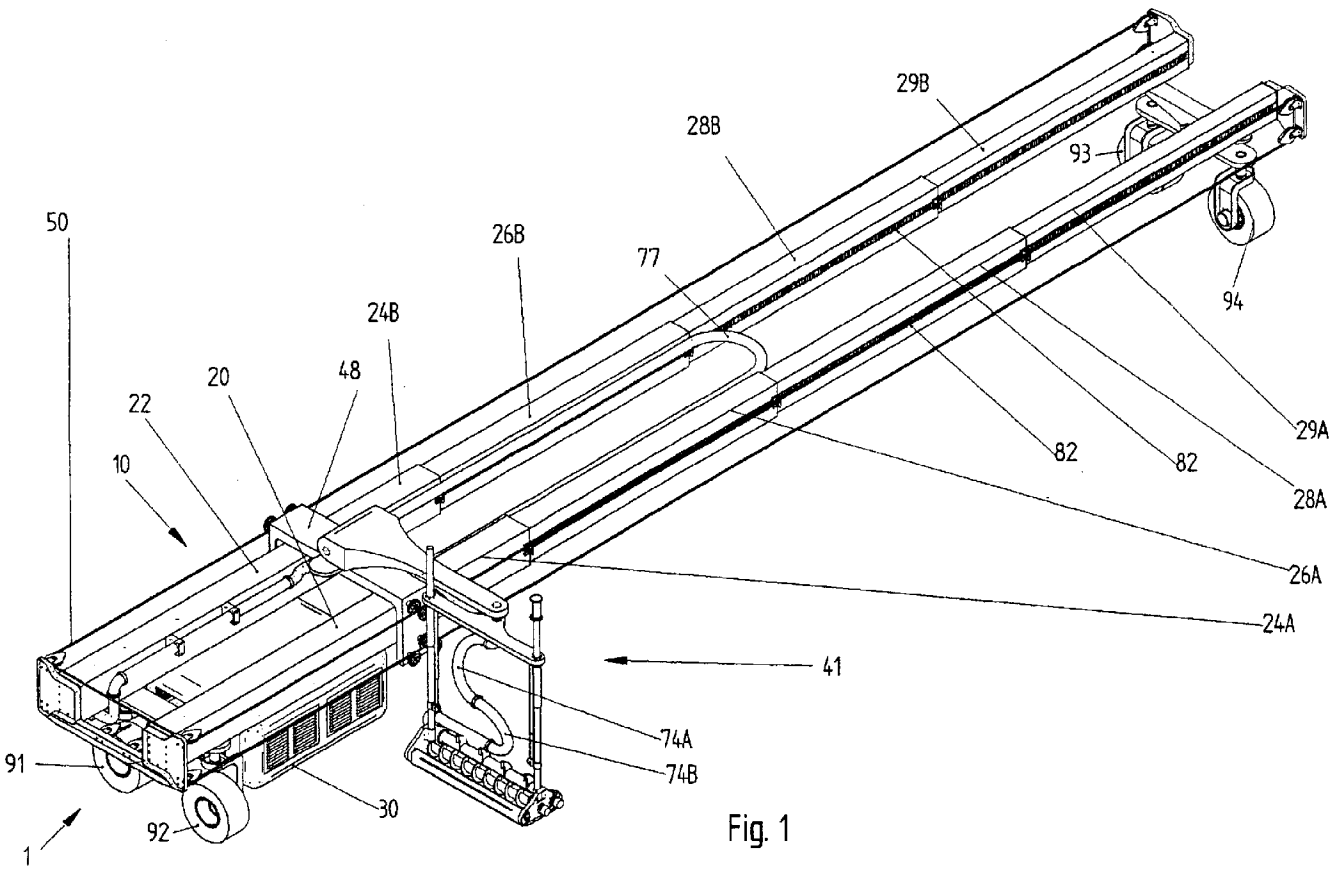
FIG. 1 is a perspective view of one embodiment of the concrete deposition machine of the invention in the extended position.

FIG. 1 is a perspective view of the concrete deposition machine 1 constructed in accordance with one version of the invention. Machine 1 generally comprises a carrier 10; a tool train 40 for placing, leveling and screeding concrete; and a tubular concrete delivery system 70. The demarcation between carrier 10 and the tool train 40 is shown in more detail in FIG. 1E. The elements comprising the tubular concrete delivery system 70 are illustrated in FIGS. 4A and 4B.

The carrier 10 preferably includes booms 20 and 22. As shown in the Figures, booms 20 and 22 comprises respectively boom sections 24*a*, 26*a*, 28, and 29*a*, and 24*b*, 26*b*, 28*b*, and 29*b*, each set of which are telescopically extendable in a longitudinal direction. In this embodiment, boom sections 24*a* and 24*b* have the largest cross sectional dimensions, with boom sections 26*a* and 26*b*, 28*a* and 28*b*, and 29*a* and 29*b* each being successively smaller than its larger neighbor to allow telescoping of the boom sections forming booms 20 and 22. This arrangement allows the boom sections 24*a*, 26*a*, 28*a*, and 29*a* to nest one inside the other, as can sections 24*b*, 26*b*, 28*b*, 29*b* to allow carrier 10 to collapse to a length only slightly longer than sections 24*a* and 24*b* themselves.

Carrier 10 additionally comprises an enclosure 30 in which components for operating machine 1 may be mounted. These components may include control elements, an engine or motor, hydraulic systems, electrical systems, cooling systems, a cable drum and winch, and fluid storage including fuel.

Carrier 10 is provided to support tool train 40 and allow translation of tool train 40 and a tool head 41 forming a part thereof, longitudinally along a predetermined path along which advances a concrete deposition front during operation of machine 1. In the original conception, tool train 40 is supported by a perimeter cable 50 extending along the two outer longitudinal surfaces of carrier 10, with an upper and lower section at each of the two surfaces. Perimeter cable 50 is under tension and functions as a constant-gauge track on which the tool train 40, supported by wheels 66*a*, 66*b*, etc., traverses along the longitudinal axis of carrier 10.

Tool train 40 may alternatively traverse along the longitudinal axis of carrier 10 riding on wheels supported directly by booms 20 and 22 of carrier 10, or on rails attached to booms 20 and 22.

Carrier 10 additionally comprises steerable drive wheels 91, 92, 93, and 94 preferably located at the corners of the machine. These steerable wheels 91–94 may include suitable motors 92*a*, etc. (FIG. 2B), to allow the machine 1 to be self-propelled and highly maneuverable.

Figure 1A:
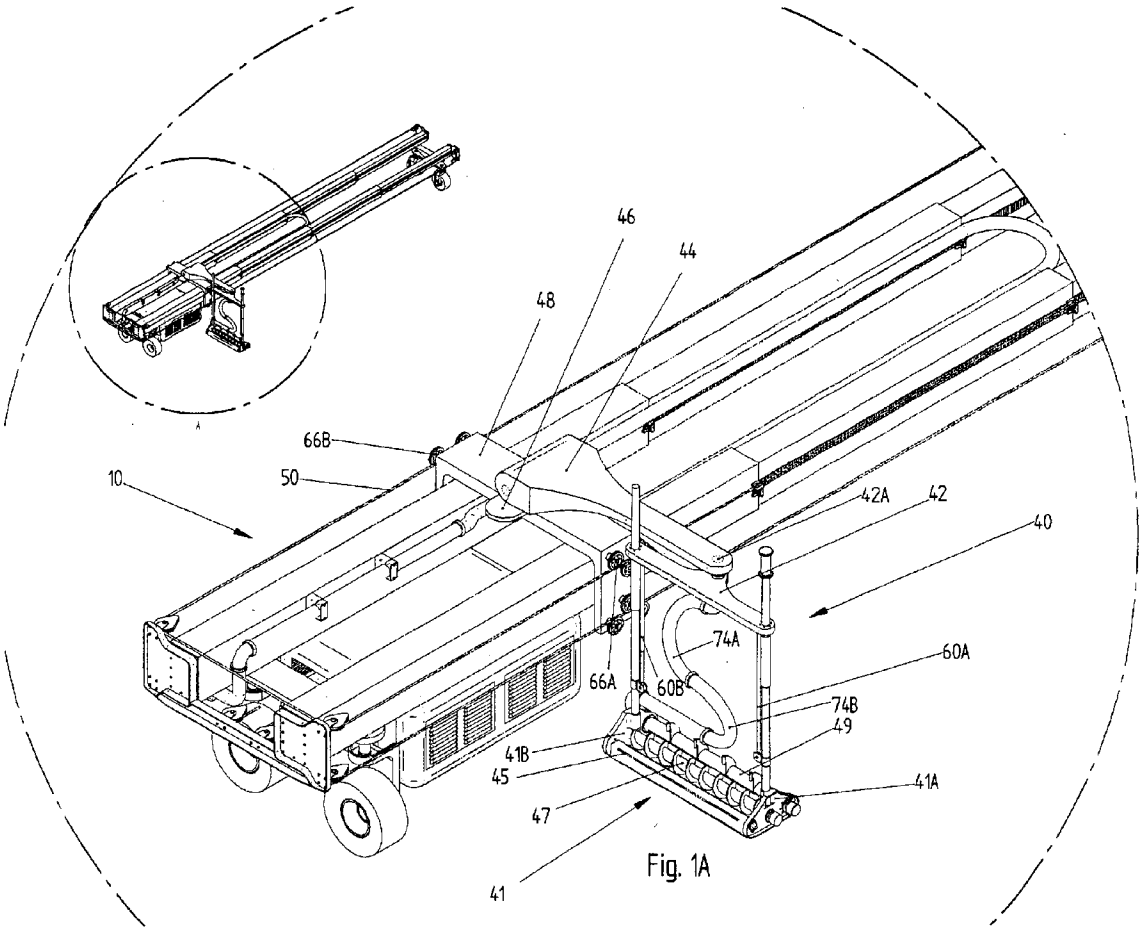
FIG. 1A is a detail perspective view of a first end of the concrete deposition machine of FIG. 1.

FIG. 1A is an enlarged perspective view of the carrier 10 and the tool train 40. As stated, tool train 40 is mounted to travel longitudinally along booms 20 and 22 carrying tool head 41 along the predetermined path. Tool train 40 comprises a trolley 48 riding on the perimeter cable 50 in addition to tool head 41. Tool head 41 includes end plates 41*a* and 41*b* for supporting a concrete valve 49, leveling auger 47, and screed 45, which are to be supported at a predetermined elevation.

A support arm 44 projects from trolley 48 and is connected to trolley 48 by a joint 46. A bracket 42 is suspended from the free end of arm 44 by a pivot 42*a*. Pivot 42*a* allows tool head 41 to rotate through 180° so that tool head 41 can form concrete while translating along carrier 10 in the predetermined path in either direction. Some type of actuator should be provided to cause this rotation.

Shafts 61*a* and 61*b* are connected to end plates 41*a* and 41*b* to support the tool head 41, and slide through journals forming a part of bracket 42. Actuators 60*a* and 60*b*, which may be mechanical, electrical, or hydraulic, apply force to cause shafts 61*a* and 61*b* to slide up and down through the journals of bracket 42, thereby controlling the vertical position of tool head 41 and its spacing above the subsurface. All of these support and positioning elements of tool head 41 comprise a tool head frame.

Wheels 66*a*, 66*b*, etc. are mounted for rotation on trolley 48 and support trolley 48 on cable 50. Electric or hydraulic motors drive wheels 66*a* and 66*b*. When torque is applied to wheels 66*a* and 66*b*, trolley 48 is caused to move along cable 50 and carrier 10 carrying the tool head 41.

This motion allows the components of tool head 41 to simultaneously and continuously place, level, and screed concrete along a constantly advancing front of freshly deposited plastic concrete. Screed 45 should have a predetermined vertical alignment relative to auger 47 permitting accurate final formation of the concrete profile and elevation by screed 45. Auger 47 should be designed when rotated at an appropriate speed and moved along the predetermined path at an appropriate speed, to remove concrete to a level where operation of screed 45 results in the desired final profile and elevation for the concrete.

Figure 1B:
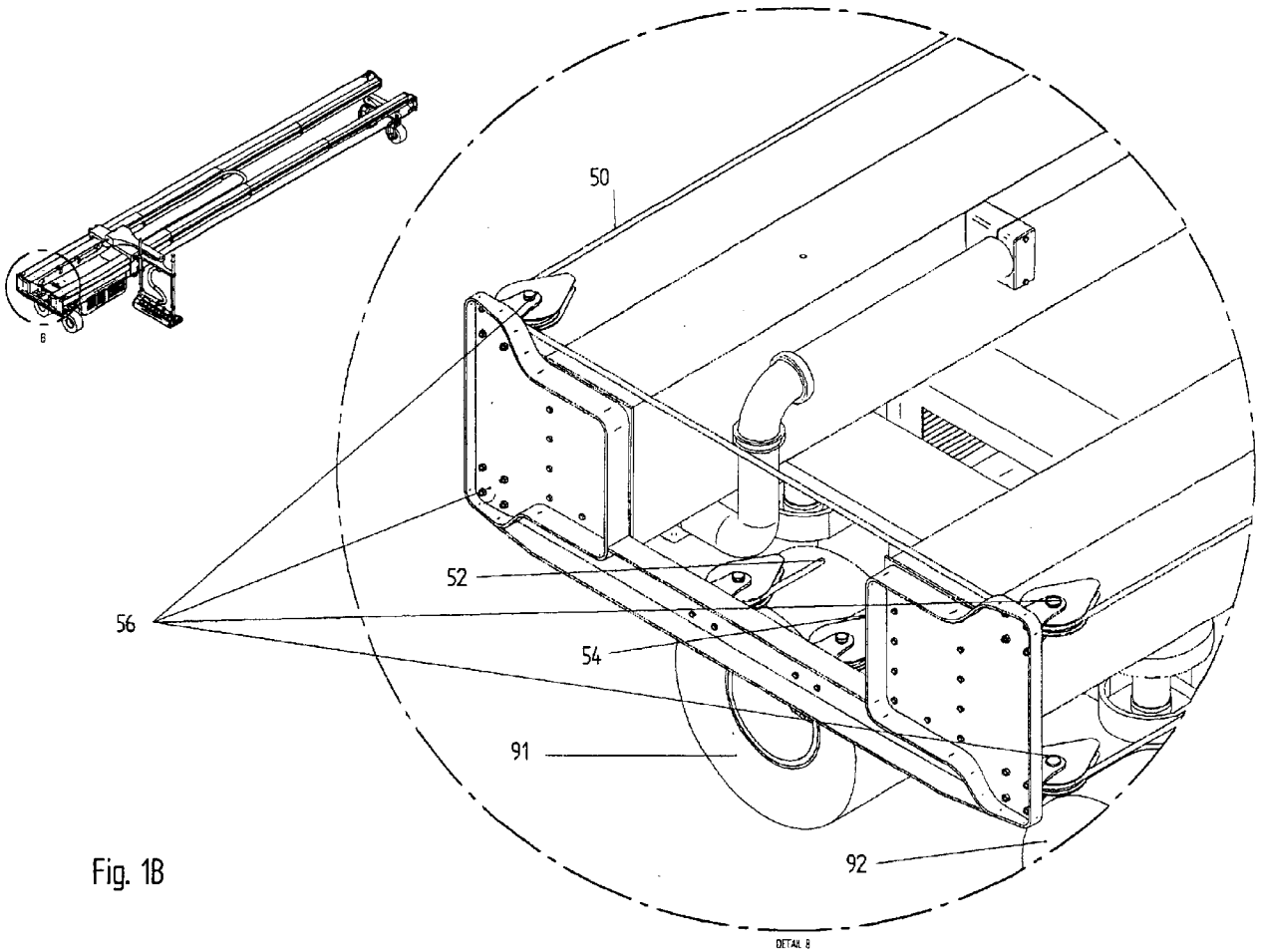
FIG. 1B is an enlargement of a part of the detail view of FIG. 1A.
Figure 1C:
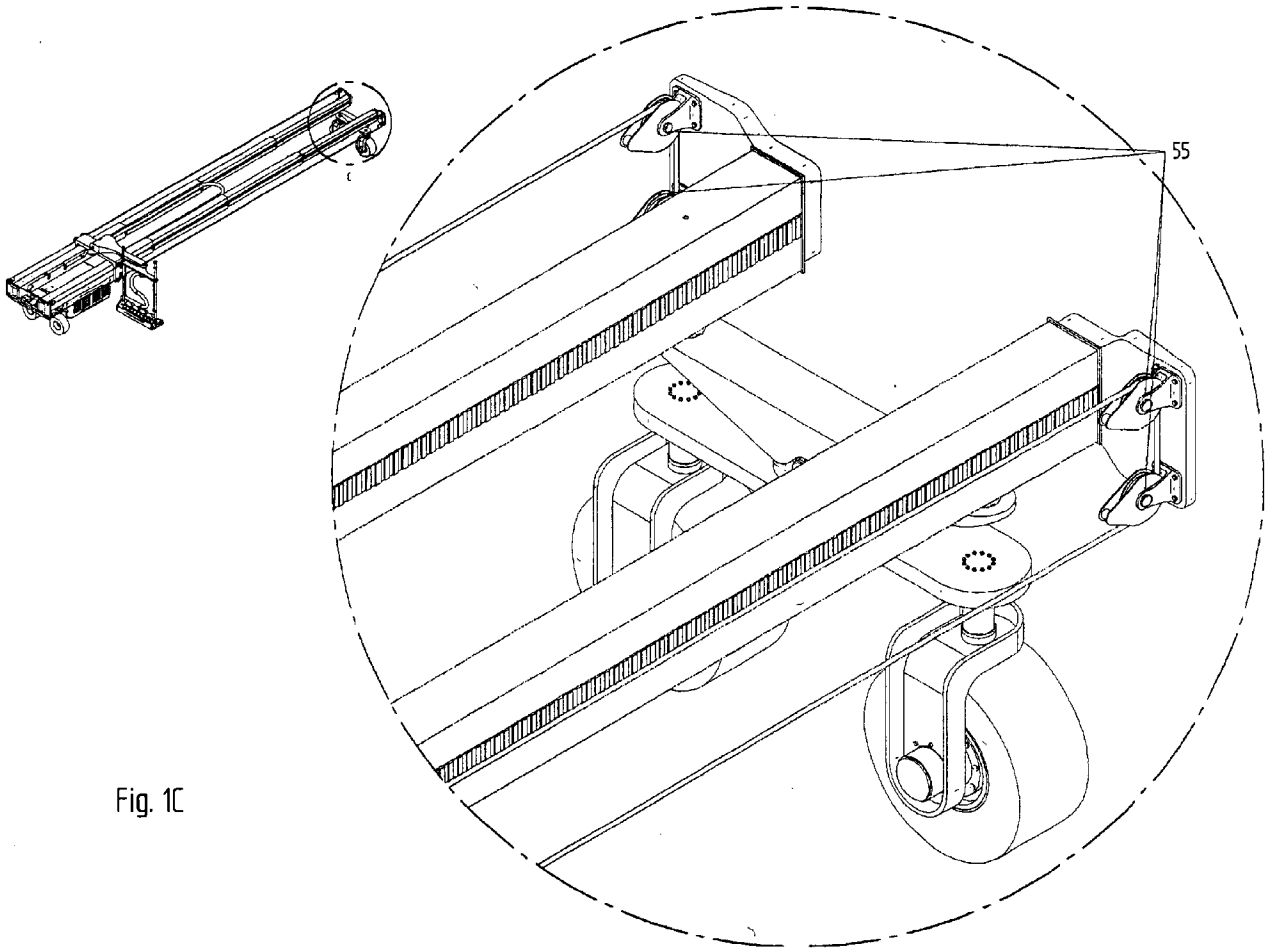
FIG. 1C is a detail view of a second end of the concrete deposition machine of FIG. 1.

FIG. 1B and FIG. 1C show elements of the perimeter cable 50 at the first and second ends of the machine 1. FIG. 1B shows horizontal pulleys 56 at the first end of the machine 1 and the origin 52 and terminus 54 of the cable.

FIG. 1C shows vertically oriented pulleys 55 and detail at the second end of the machine 1.

Figure 1D:
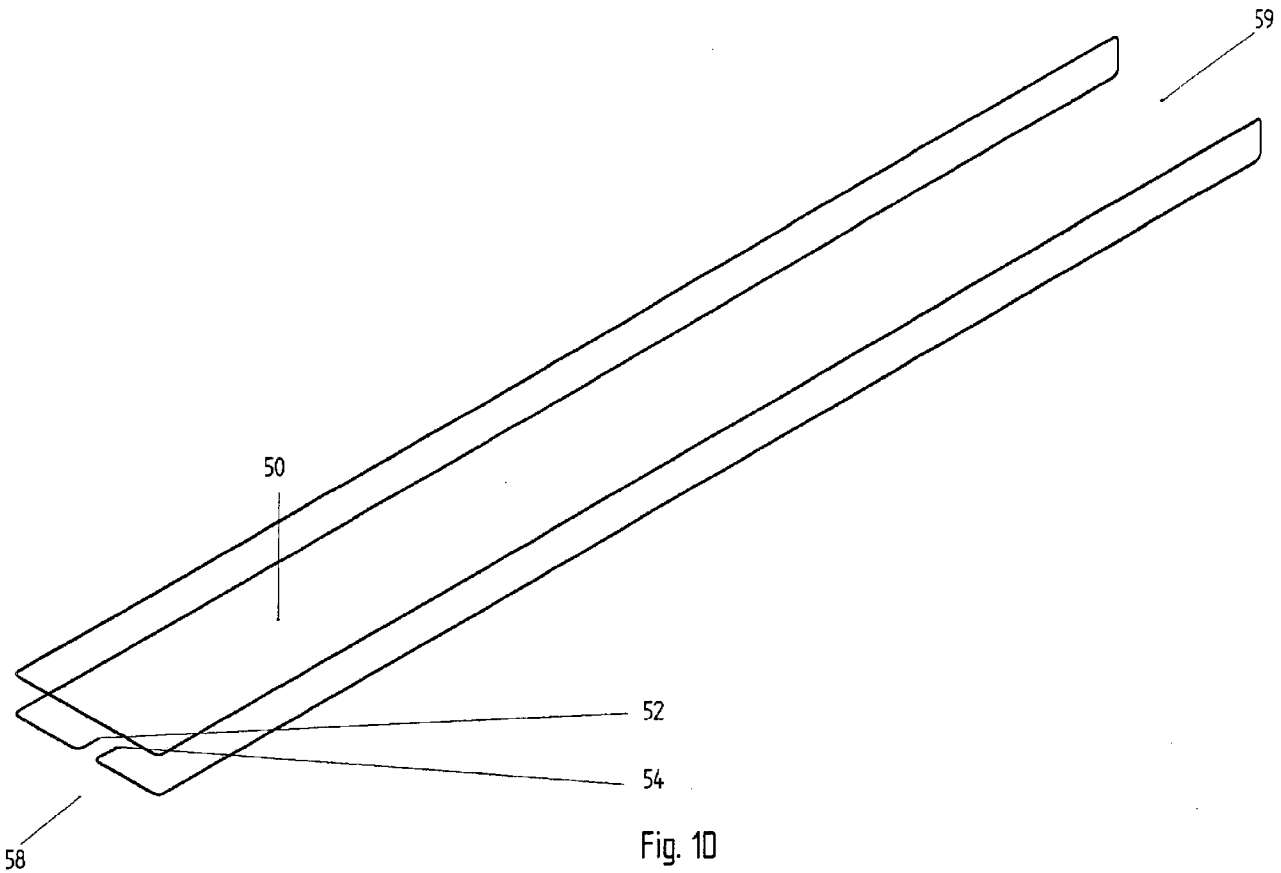
FIG. 1D shows the shape of a cable supporting a tool train forming a part of the concrete deposition machine of FIG. 1.

FIG. 1D shows a perspective view of the cable 50 to illustrate the cable path. The first end is at 58; the second end is at 59. Cable spools from a winch at 52 (not shown), travels around the pulleys, and is anchored at 54 to the carrier 10 near the winch, see FIG. 2. This design allows the cable 50 to be lengthened and shortened to match the current length of carrier 10 as boom section 26*a* and 26*b*, 28*a* and 28*b*, and 29*a* and 29*b* are extended from boom sections 24*a* and 24*b* to produce the desired overall length of machine 1.

Figure 1E:
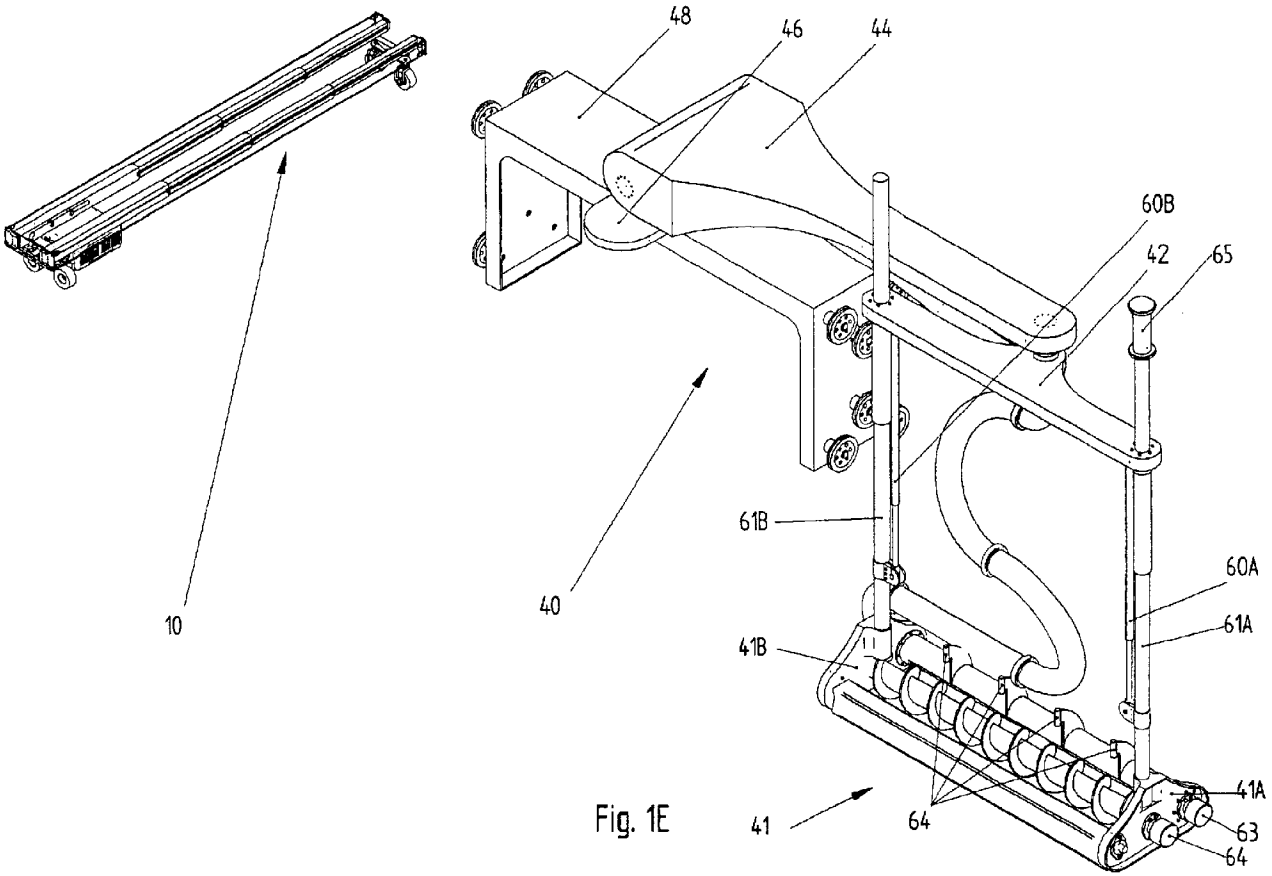
FIG. 1E is a detail view of a tool train forming a part of the concrete deposition machine of FIG. 1.

FIG. 1E shows an enlarged perspective view of the tool train 40, reflecting additional elements thereof. Sensors 64 are attached in an array at various positions on the tool head 41. Sensors 64 detect the elevation of delivered plastic concrete behind and/or ahead of the deposition front, and provide signals indicating an excess or insufficiency of concrete. The signals may be used to automatically control the position and rate along the deposition front at which concrete is placed, and the rate of travel by tool train 40 along the predetermined path. Sensors 64 signals may also be used by an operator to determine a proper rate of motion of the tool train 40 along the carrier 10. Sensors 64 may be variously sonic, optical, or hybrid devices.

Sensors such as sensor 65 mounted on shaft 61*a* provide a signal indicating the current height or elevation of screed 45 and auger 47 with respect to some external reference such as a laser, GPS transmitter, robotic total station signal, or other device. The sensor 65 signals provide information that allows actuators 60*a* and 60*b* to be controlled to regulate the vertical position of the tool head 41, and thereby of the auger 47 and screed 45. Controlling the elevation of tool head 41 and the leveling auger 47 and concrete screed 45 forming a part of tool head 41 determines the elevation and profile of the finished concrete surface.

Figure 2:
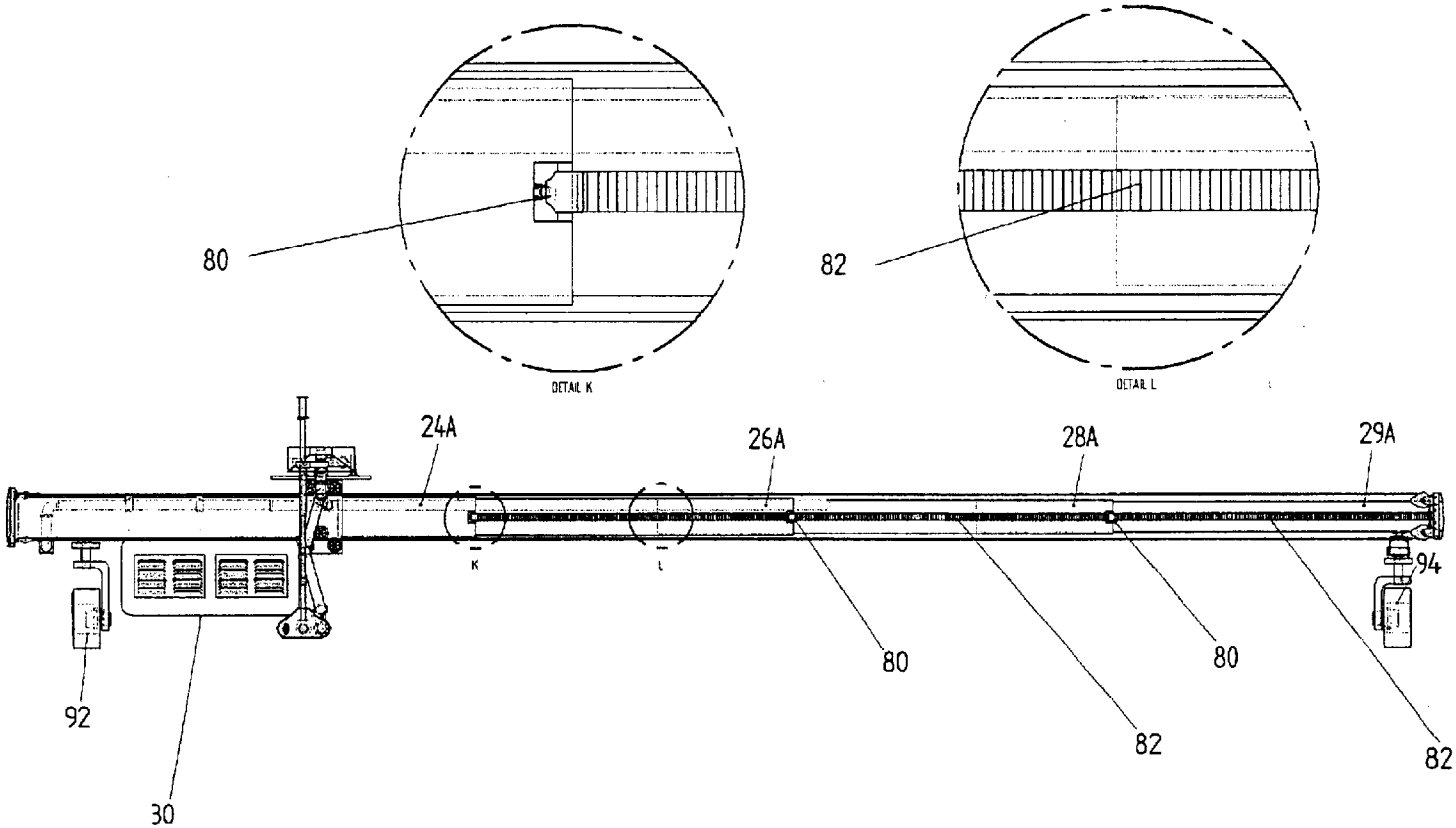
FIG. 2 is a front elevation view of the concrete deposition machine as shown in FIG. 1.

FIG. 2 is a front elevation view of machine 1 showing enclosure 30 for containing mechanical components. Mechanical components are conveniently arranged within the enclosure 30 and may include the engine, hydraulic systems, electrical systems, deposition controls, the cable winch, the frame anchor, and fluid storage including fuel.

FIG. 2 additionally shows a first detail of a rack 82 having a plurality of projecting teeth extending longitudinally along the front side of extension boom sections 26*a*, 28*a*, and 29*a*. A second detail shows a pawl and actuator assembly 80*a*, which engages the teeth of rack 82 at the end of main boom section 24*a*. The rack 82 and pawl and actuator assembly 80 are a possible means to lock extended boom section 26*a* in position in this embodiment. Rack elements 80 are also positioned along the backside length of extendible boom sections 26*a*, 28*a*, and 29*a* (hidden in the drawings). Pawl and actuator assemblies 80*b* and 80*c* are also provided at the ends of extension boom sections 26*a* and 28*a* on both the visible side as shown in the drawings as well as on the back side (hidden in the drawings) of boom 20. A rack, pawl and actuator assembly similar to rack 82 and pawl and actuator assemblies 80*a*, 80*b*, and 80*c* are also provided along the rearward boom 22 (also hidden in the drawings in this perspective).

Figure 2A:
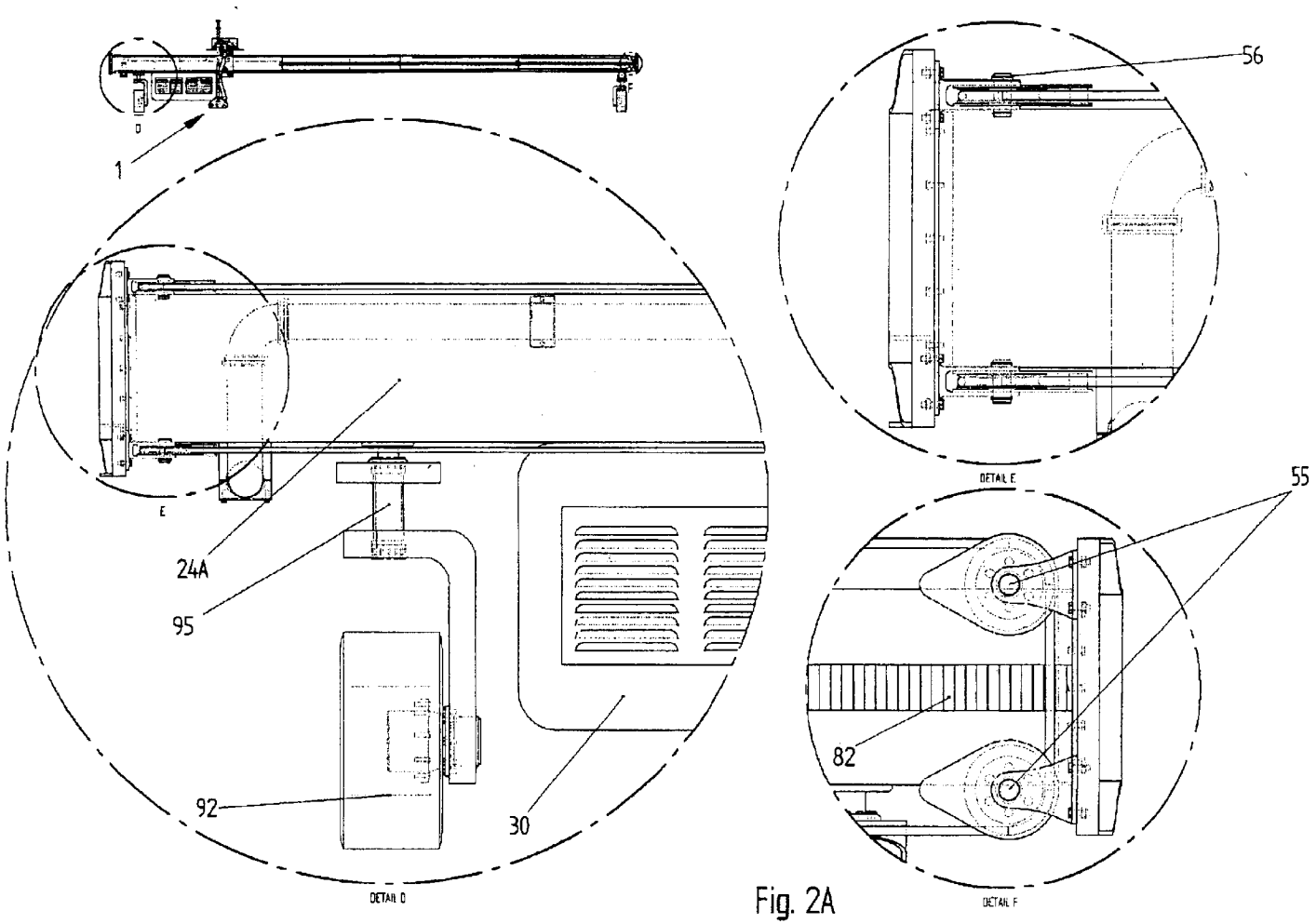
FIG. 2A is three detail front elevation views of the cable and pulley system of FIG. 2.

FIG. 2A provides detail front and top elevation views of pulley arrangements and some steering functions. Vertical pulleys 55 are preferably situated at the second end of the last extension boom section 29*a*; horizontal pulleys 56 are preferably located at the first end of the main boom section 24.

FIG. 2A also shows a compact rotary actuator 95 that provides rotational steering for wheel 92 of machine 1. An electric or hydraulic motor within wheel 92 and the other wheels 91, etc. provides torque to wheels 91, etc., allowing machine 1 to be moved during concrete deposition, around the job site, and to and from a road transporter on the job site.

Figure 2B:
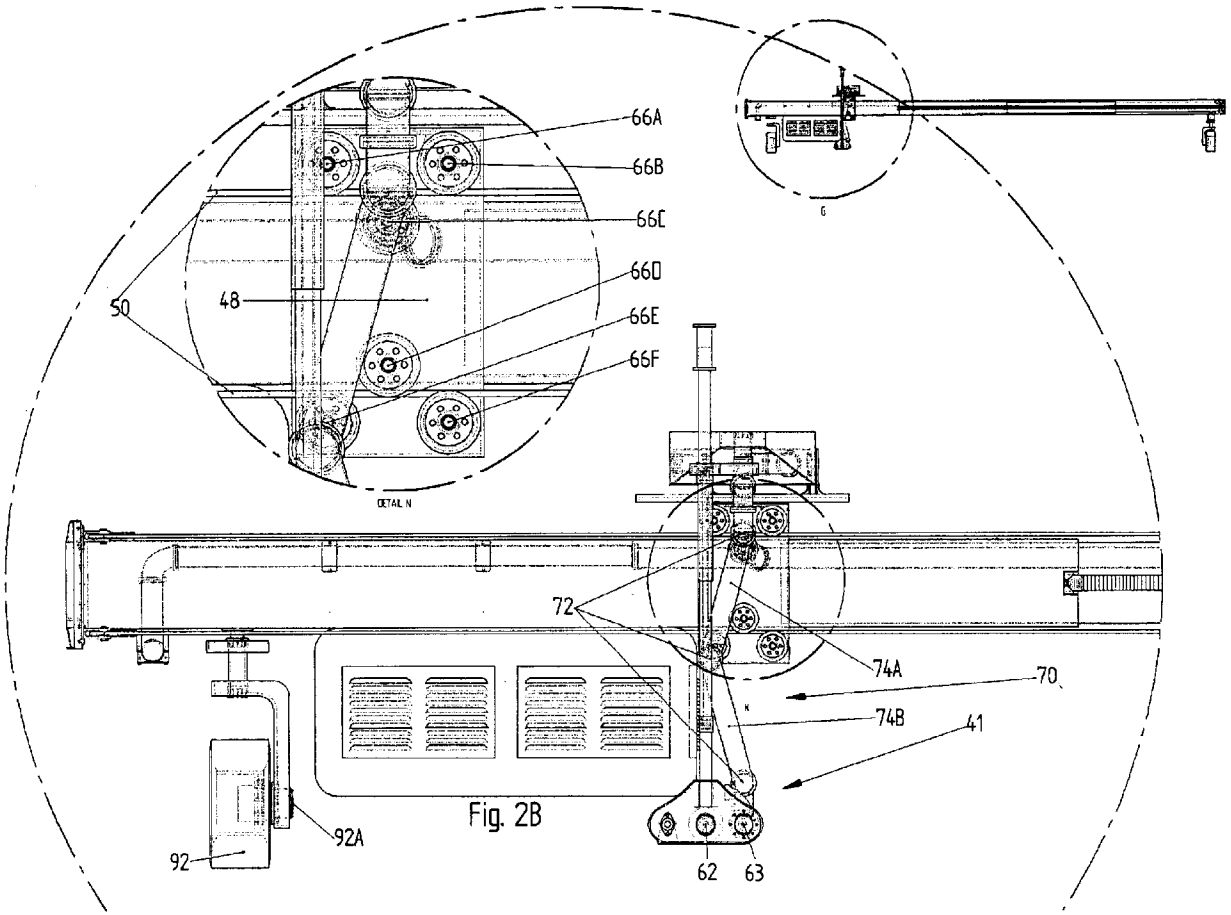
FIG. 2B is detail front elevation of the first end of FIG. 2.

FIG. 2B shows how certain elements of the concrete delivery system 70 remain in constant connection with tool head 41 to permit continuous deposition of concrete along the deposition front. In order to accommodate adjustments in the height of the tool head 41, delivery system 70 has tool train sections 74*a* and 74*b* that articulate to accommodate vertical movement of tool head 41 in response to elevation sensor inputs or manual control. Individual tubes 74*a* and 74*b* of concrete delivery system 70 are rigid elements and articulate by virtue of multiple swivel connectors at joints 72. This articulation allows tool head 41 to move vertically in response to force of actuators 60*a* and 60*b* without interrupting flow of concrete to tool head 41.

Figure 3:
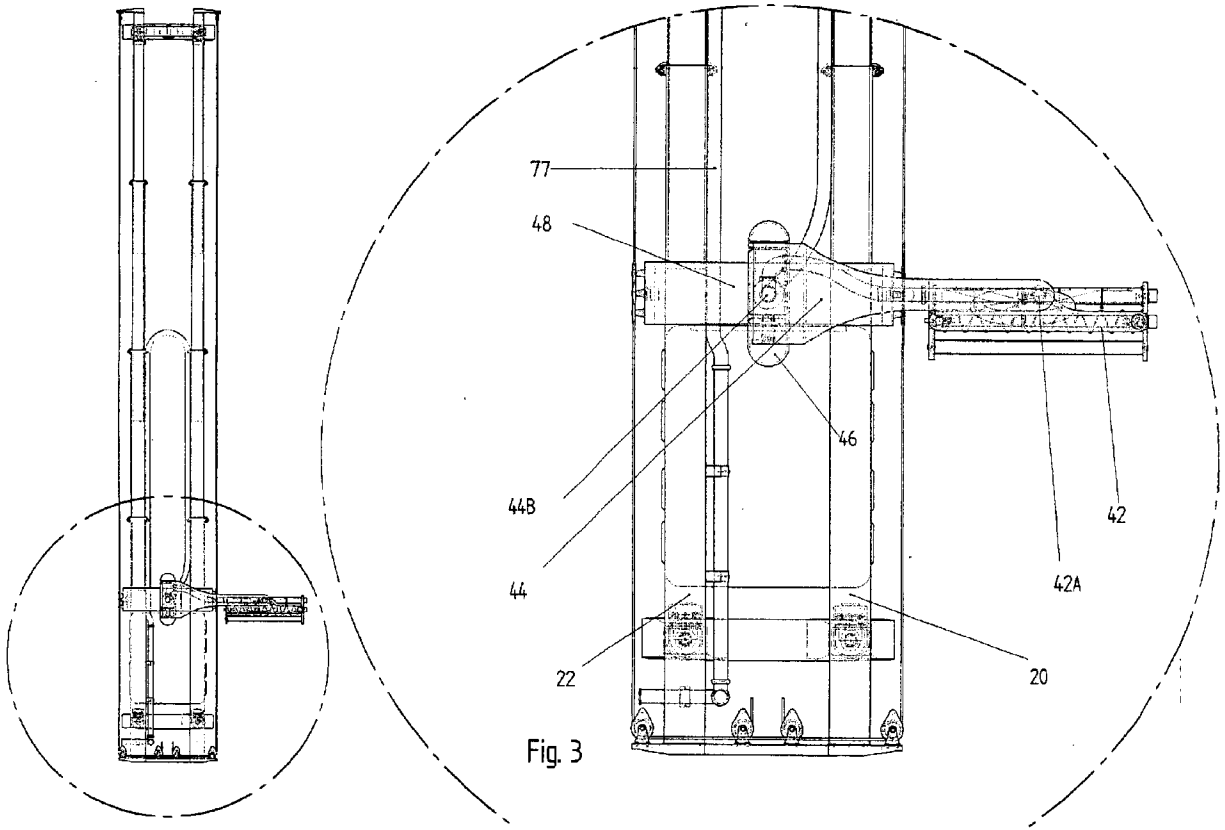
FIG. 3 is a top elevation view of the machine in the extended position and a detail of this view.

FIG. 3 is a top elevation view of the tool train 40. Pivot 42*a* allows bracket 42 to rotate 180° relative to arm 44. This feature is useful to properly orient tool head 41 at the end of each pass without having to return to the opposite end of carrier 10 for another pass. This orientation of tool head 41 is necessary to allow concrete valve 49 to lead no matter the direction of the tool train 40 movement along carrier 10.

Figure 3A:
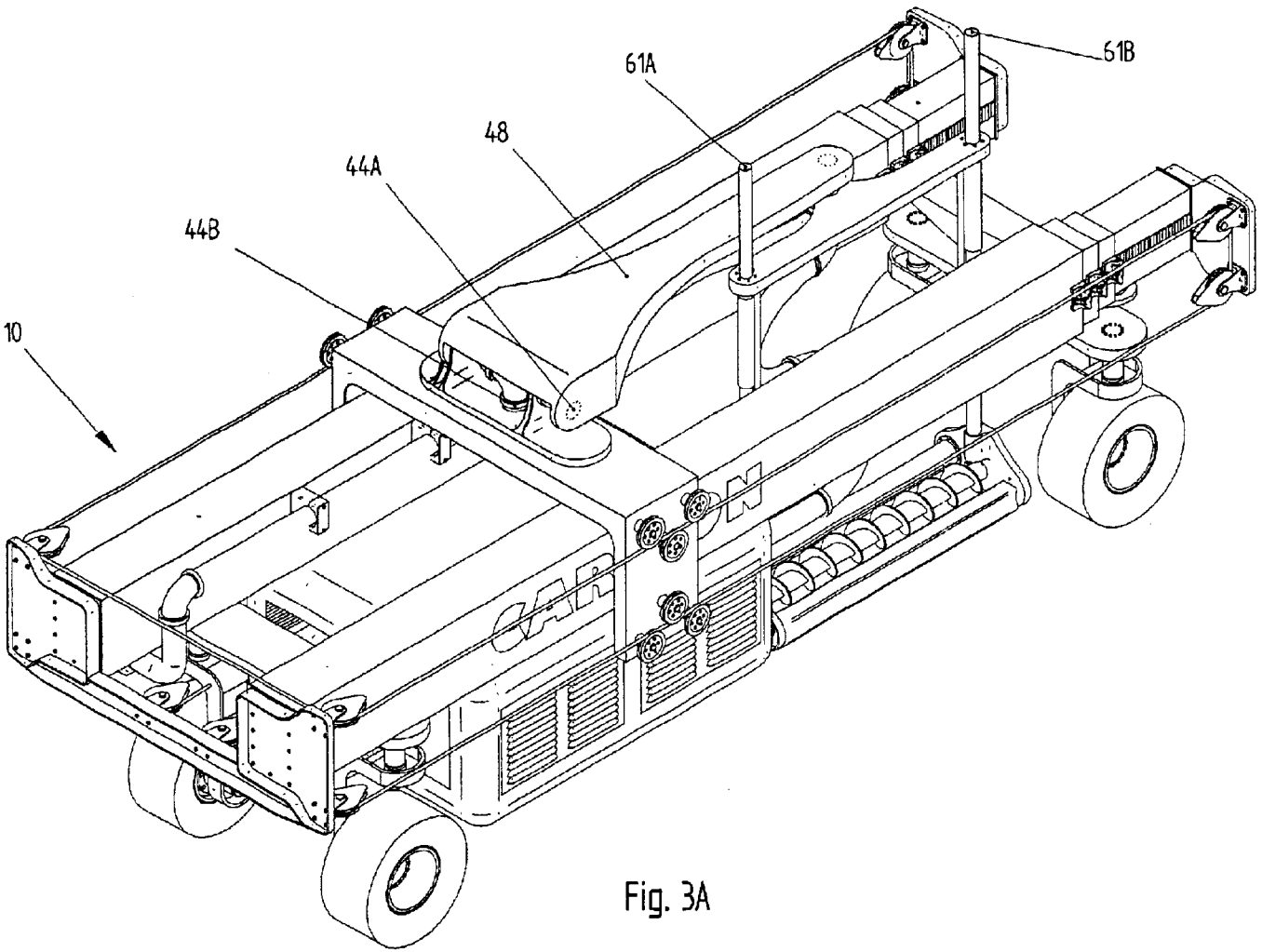
FIG. 3A is a perspective view of the machine in a parked position and ready for moving on a job site or road transport on a trailer.

FIG. 3A shows machine 1 in transport position, with booms 20 and 22 fully retracted and tool train 40 situated in between booms 20 and 22. In one embodiment, arm 44 is attached to trolley 48 by a horizontal-axis pivot 44*a*, which allows arm 44 to rotate 90° into a nearly upright position. A second pivot 44*b* has a vertical axis that allows arm 44 to rotate 90°. Then arm 44 can be again rotated on pivot 44*a* into a parked position for transport as shown. In the parked position the longitudinal axis of arm 44 and the long dimension of tool train 40 are parallel to and between boom 20 and boom 22. Force for rotational motion at pivots 44*a* and 44*b* may be provided by any suitable means well within the skill of technicians.

FIG. 3B is an elevation view of FIG. 3 showing the engagement of the pawl and actuator assembly 80 with the rack 82 occurring between boom section 28 and boom 29 on boom 20. A similar arrangement is present on both sides of both booms 20 and 22.

Figure 4:
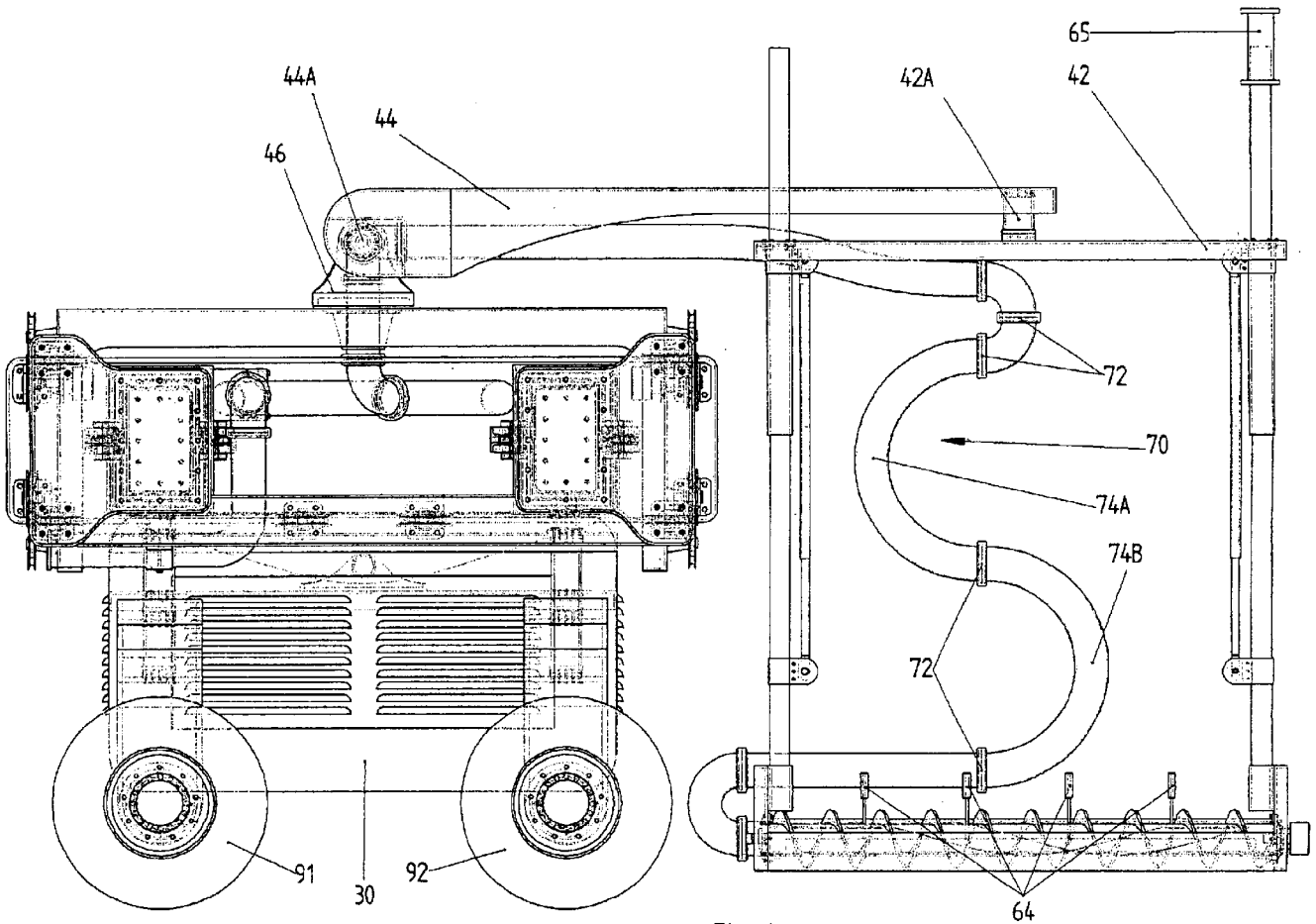
FIG. 4 is an end elevation view of the embodiment of FIG. 1.
Figure 4A:
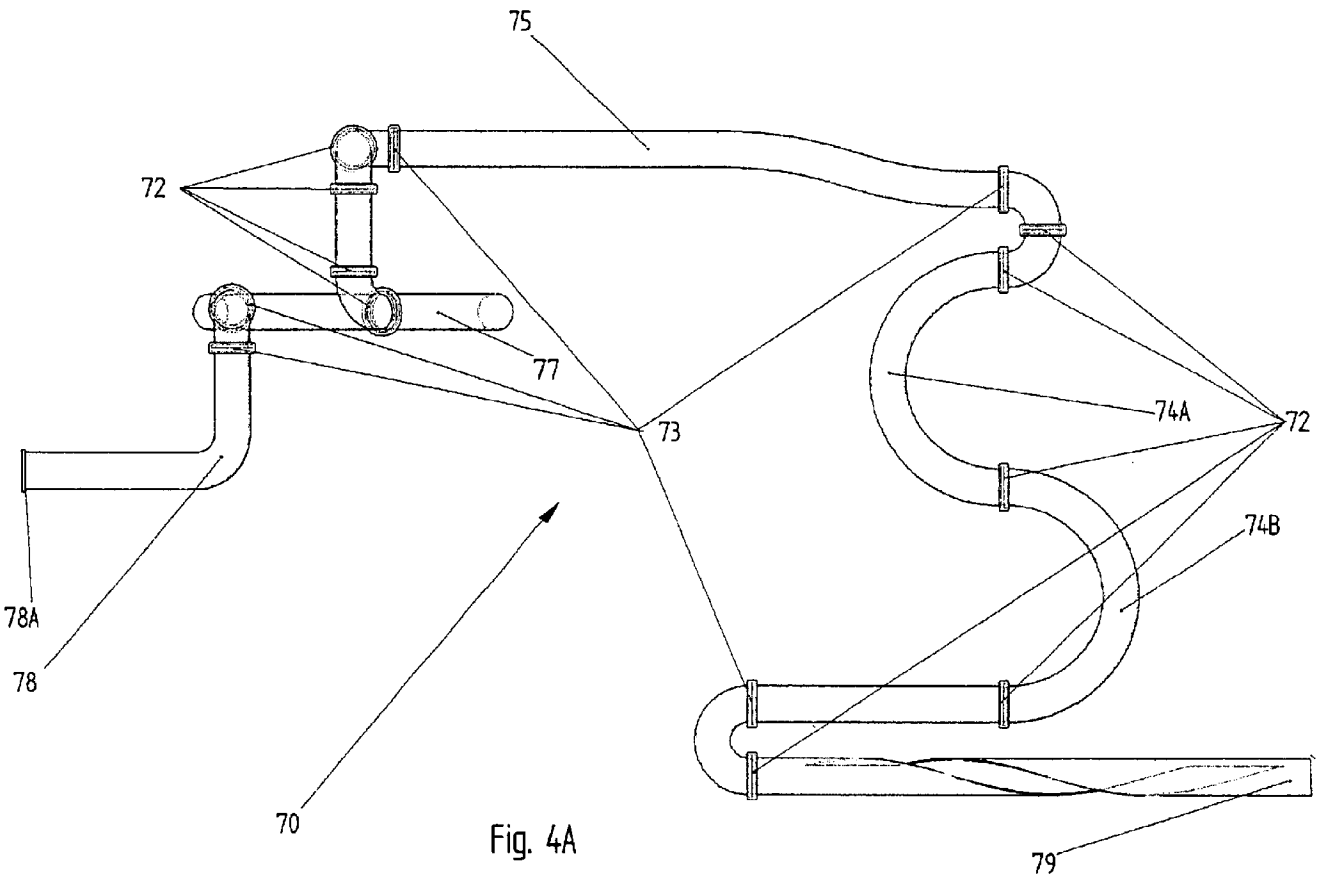
FIG. 4A is an end elevation view of the concrete delivery system of the embodiment of FIG. 1.
Figure 4B:
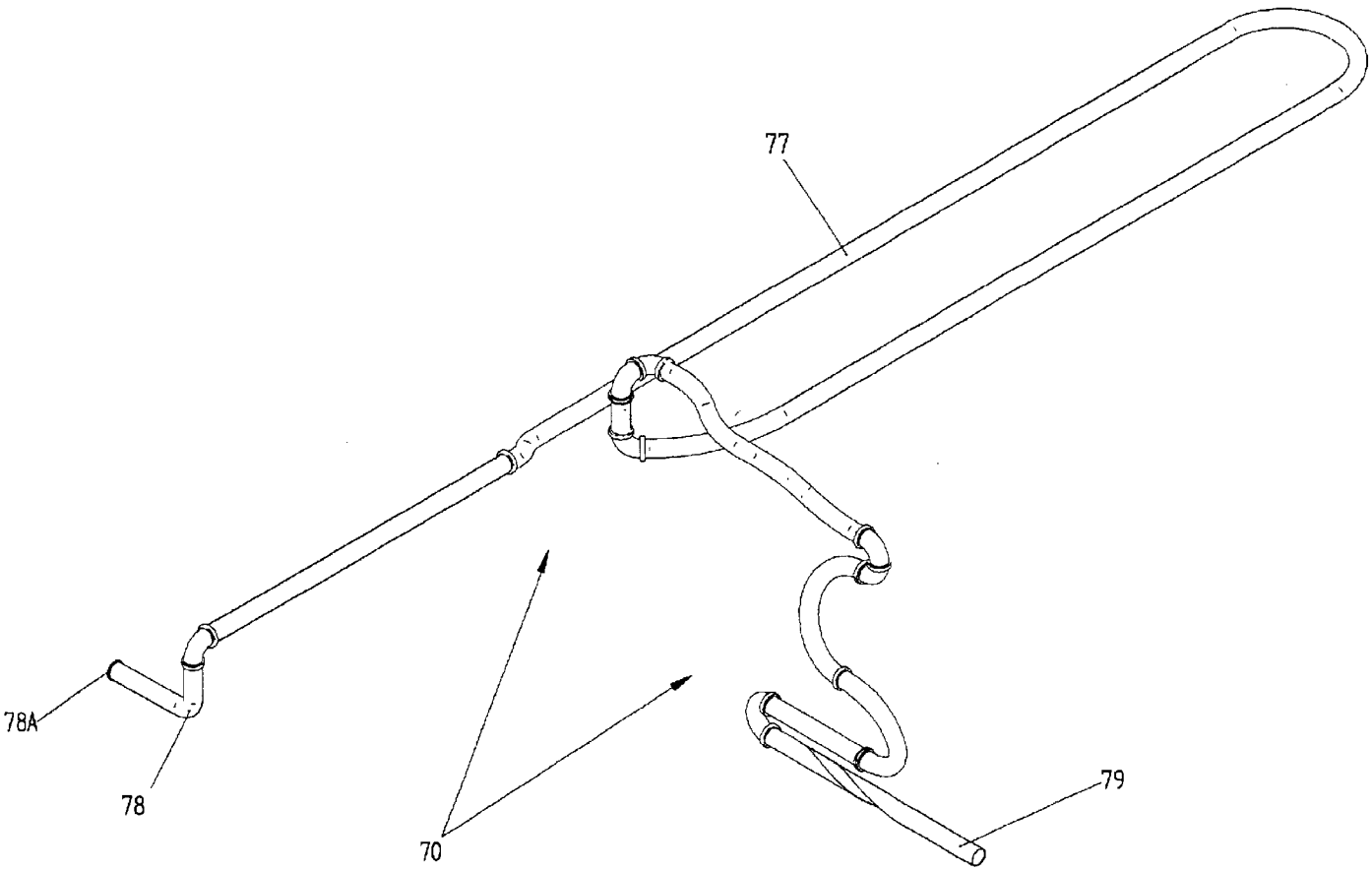
FIG. 4B is a perspective view of the pipe and hose system of the embodiment of FIG. 1.

FIG. 4 is a left elevation view of the first end of the machine as shown in FIG. 1. Pivot 42*a* may include a compact rotary actuator (not shown) that provides torque between arm 44 and bracket 42. Pivot 44*a* may include a similar actuator (also not shown), which provides torque for effecting rotation of arm 44 relative to trolley 48.

Tubular concrete delivery system 70 includes a carrier element 77 that accommodates the motion of the tool train 40 along the carrier 10 to provide a constant supply of concrete to tool train 40. The tubular concrete delivery system 70 additionally includes a tool train section 74A, 74B, etc. accommodates the motion of the tool head 41 relative to the rest of the tool train 40.

FIG. 4A is a left elevation view of concrete delivery system 70. In one embodiment, elements of concrete delivery system 70 are comprised substantially of rigid concrete tube sections 74A, etc. having the various shapes and configurations shown in FIGS. 4A and 4B. These tube sections are joined with swivel connectors 72 and clamp connectors 73. Clamp connectors 73 connect two rigid tube sections into a rigid assembly. Swivel connectors 72 mate two tube sections allowing rotation between the tube sections. Swivel connectors 72 thus allow a group of connected rigid tube sections 74A, etc. to accommodate relative movement between, say, bracket 42 and tool head 41. In a preferred embodiment, carrier element 77 is flexible, perhaps comprising a concrete hose.

In the preferred embodiment, element 77 is horizontally disposed between booms 20 and 22 of carrier 10, supported by drop-in cross members between the booms (not shown). This arrangement allows element 77 to smoothly flex and at the same time remain in the horizontal plane as tool train 40 traverses the length of carrier 10.

Concrete enters the concrete delivery system 70 from a remote concrete pump or hopper (not shown) at point 78A of an inlet pipe 78. Concrete flows through the concrete delivery system 70 and is discharged from concrete valve 49, shown with particularity in FIG. 5*a* and FIG. 5*b*, along and ahead of the constantly advancing deposition front.

FIG. 4B shows the complete concrete delivery system 70 in an angled perspective view and removed from machine 1. Element 77 is shown as a flexible concrete hose doubled back on itself in a "U" shape. The element 77 assumes this configuration as the tool train 40 traverses the longitudinal axis of the machine 1 toward the first end. As the tool train 40 traverses the longitudinal axis of the machine 1 toward the second end, one leg of element 77 shortens and the other lengthens. Smooth flexing of the concrete hose 77 may require a retractor of some type constantly urging the "U" bend thereof toward the right end of carrier 10.

Figure 5:
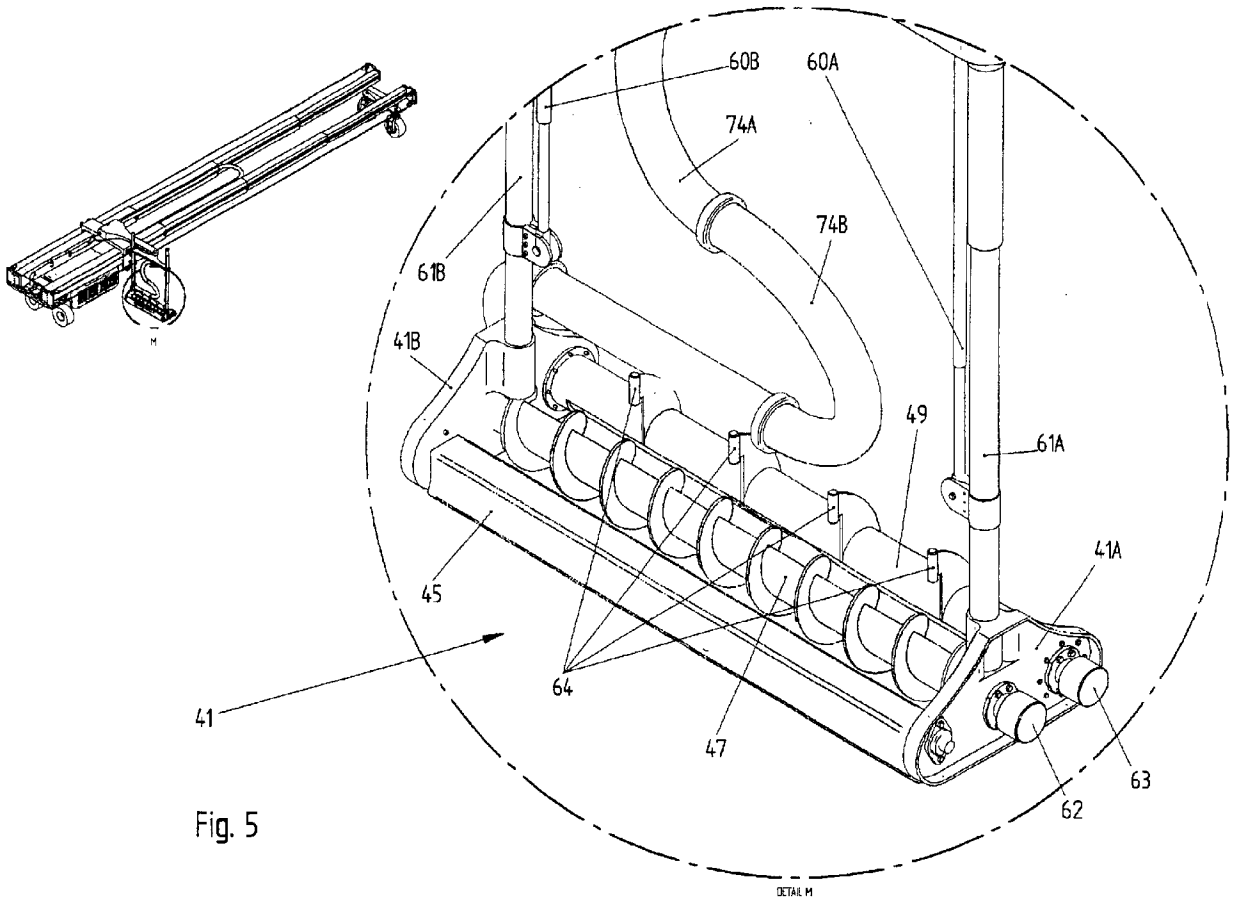
FIG. 5 is a detail of a perspective view of the tool head and a portion of the concrete delivery system of the embodiment of FIG. 1.
Figure 5A:
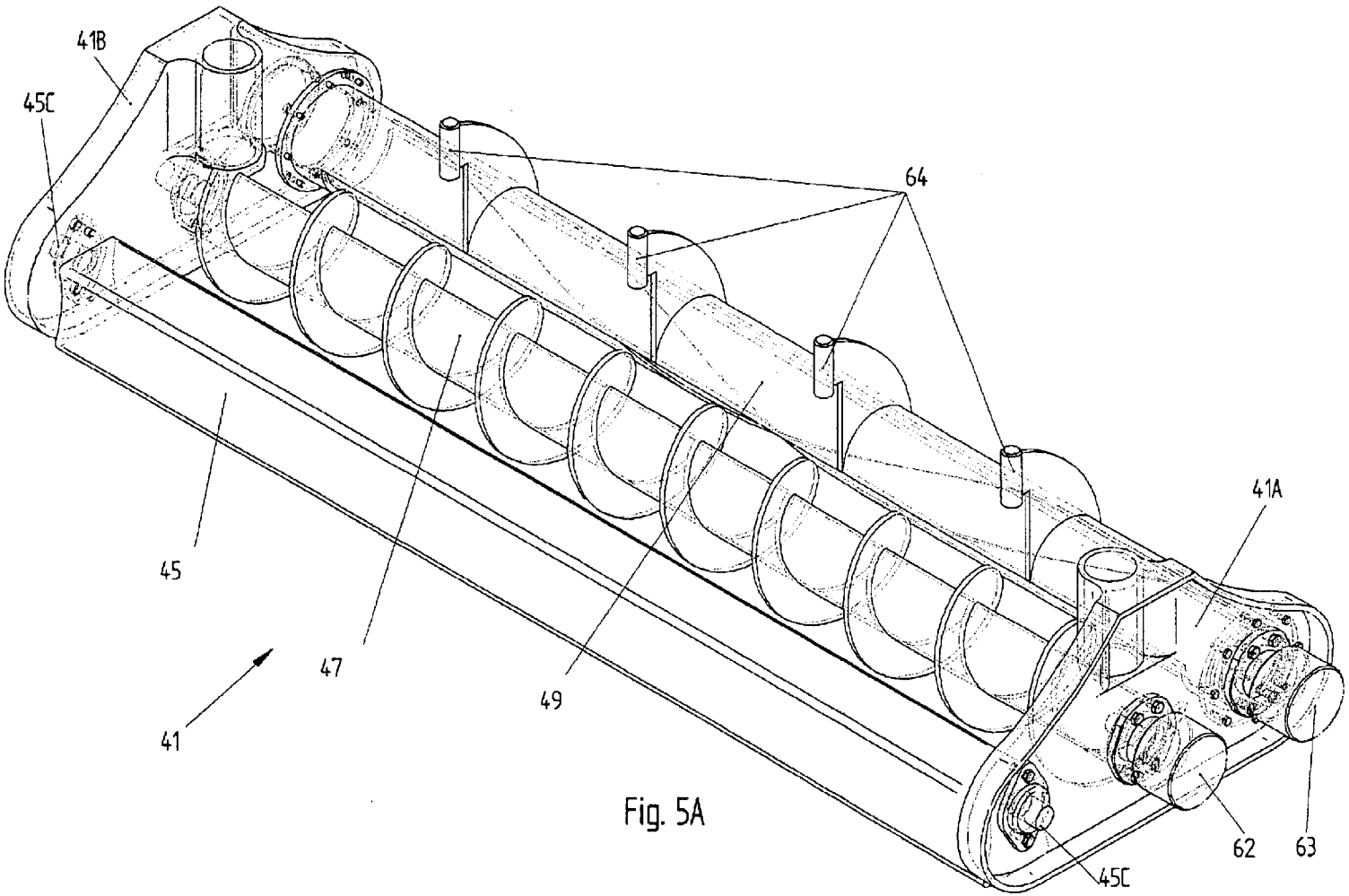
FIG. 5A is an enlarged perspective view of the tool head of FIG. 5.
Figure 5B:
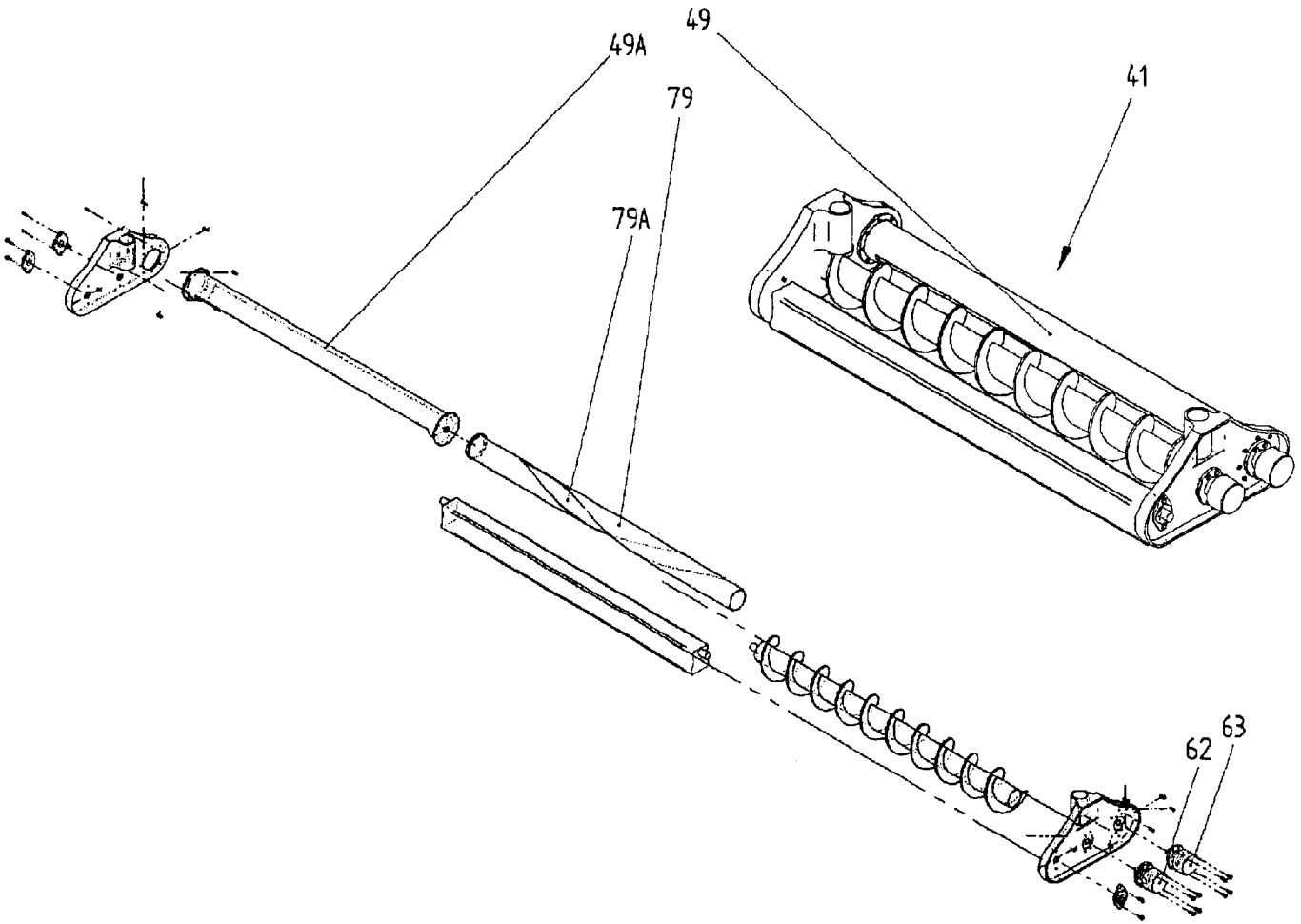
FIG. 5B is an exploded perspective view of the tool head of FIG. 5A.

FIG. 5, FIG. 5A, and FIG. 5B show tool head 41 details. FIG. 5 shows the tool head 41 and the attachment of the actuators 60*a* and 60*b* and shafts 61*a* and 61*b* for guiding and for raising and lowering tool head 41. FIG. 5A shows components of the tool head 41 as concrete valve 49, leveling auger 47 and screed 45. It is convenient to specify the concrete valve 49 as defining a leading edge of tool head 41 and screed 45 or auger 47 (when screed 45 is not provided) to define a trailing edge of tool head 41. Tool head 41 when depositing concrete must always move along the predetermined path with concrete valve 49 leading. The leading edge defines a constantly advancing deposition front along which concrete is continuously being placed.

A preferred means to spread concrete evenly and controllably along the deposition front is a rotary concrete valve 49, shown in exploded perspective view in FIG. 5B. Rotary concrete valve 49 comprises a stationary outer tube 49*a* and an inner rotating tube 79. Tube 79 has a helical slot 79*a* that extends along a substantial portion of its length, and is wide enough to allow plastic concrete under system pressure to easily pass through a short length of helical slot 79*a*.

Inner tube 79 closely fits within outer tube 49*a*. Outer tube 49*a* has a straight slot extending along a portion of its length and conforming to the length of the helical slot in the rotating inner tube 79. The straight slot opening of tube 49*a* may be oriented 'down' or rotated so as to partially face the deposition front of tool head 41. The width of the tube 49*a* slot should also allow concrete to easily pass through a short length of the tube 49*a* slot when under low pressure.

Tube 49*a* is fixed to end plates 41*a* and 41*b*. Concrete is discharged by the rotary concrete valve 49 along its axial length at a point determined by the rotational alignment of the portion of the slot in the stationary element 49*a* that is aligned with the helical slot 79*a* in the inner rotating element 79. The inner rotating element 79 is controllably driven by servomotor 63 during operation, causing an opening to the inside of tube 79 to controllably oscillate along the length of tube 79. This arrangement allows varying amounts of concrete to be discharged by rotary concrete valve 49 along the deposition front in response to sensor 64 inputs, thereby accommodating uneven subgrade conditions and other requirements.

Alternative means to evenly discharge concrete from the concrete delivery system 70 along the distribution front could include, for example, a discharge chute or nozzle and a mechanism to controllably oscillate the chute or nozzle back and forth along the deposition path of tool head 41.

I prefer to include concrete screed 45 as a part of tool head 41. Both the concrete auger 47 and concrete screed 45 may incorporate appropriate means to achieve fine adjustment of working height and position relative to the tool head 41 end plates 41*a* and 41*b*. The angle of attack for screed 45 may be controlled by adjustment joint 45*c*. Additionally, the concrete screed 45 when present may incorporate appropriate vibrator means. As is known in the industry, these vibratory means may be rotating eccentric weights mounted on or in the screed 45. In such cases, screed 45 attaches to end plates 41*a* and 41*b* with vibration isolation mounts.

Operation

The machine is a concrete placing and screeding machine. The machine is preferably self-propelled, with all-wheel drive and all-wheel steering. The machine frame is preferably extendable, with one or more extending elements, allowing variable machine lengths to accommodate a variety of deposited concrete widths. One such embodiment, illustrated in FIG. 1, incorporates two extendible booms 20 and 22, each preferably having three extending sections 26*a*, 28*a*, and 29*a* and 26*b*, 28*b*, and 29*b* respectively.

The device is transported to a construction site and moved under its own motive power into position on a jobsite with various elements in transport position shown in FIG. 3A. When in position, boom sections 26, 28 and 29 are extended to the desired working width. The tool train 40 is then deployed to its working position.

To extend booms 20 and 22, first end drive frames and wheels 91 and 92 (FIG. 1) are rotated to align their axes with the longitudinal axis of the booms 20 and 22 and the wheels are locked. Second end wheels 93 and 94 are then oriented so as to roll in a direction parallel to longitudinal axis of the booms. The operator then drives wheels 93 and 94 to extend booms 20 and 22 to the desired length. Preferably, boom sections are pulled from their retracted position in order of their size, starting with the largest.

The order in which the boom sections extend may be controlled by the selective disengagement of the pawl 80 (FIG. 2) from the rack 82 (FIG. 2). This disengagement detail is shown from a top perspective in better detail at pawl 80 and rack 82 (FIG. 3B). When the extension of the boom section is at its maximum or desired length, each pawl 80 is re-engaged with rack 82.

Selectively steering and driving one or more of the wheels 91–94 positions machine 1 as the operator desires. Crabbing, rotating, and linear movements are all possible.

Perimeter Cable Rigging

The perimeter cable 50 (FIG. 1D) adjusts to the required boom length. A cable winch (not shown) that is located in the enclosure for mechanical components 30 (FIG. 2) spools length as required (shown at cable strand 52 (FIG. 1D)). The opposite end of the perimeter cable 54 (FIG. 1D) extends into the enclosure for mechanical components 30 (FIG. 2), where it is anchored to a frame element of the device 1.

The cable winch is configured to maintain a steady tension on the perimeter cable 50 when the booms 20 and 22 are locked by engagement of the pawl 80 and rack 82. Tension on the perimeter cable 50 applied by the cable winch is relaxed before pawl 80 is disengaged from rack 82, so as to allow boom sections 26, 28 and 29 to extend.

Basic Motion

The tool train 40 travels back and forth along the longitudinal axis of the booms 20 and 22. The tool train 40 is mounted on a trolley 48, which in turn engages the perimeter cable system 50 (FIG. 1) by an array of pulleys 66*a*, 66*b*, etc. (FIG. 2B) located at each end of trolley 48. Motors mounted on the inside of the trolley 48 may drive one or more of the array pulleys through a friction drive engagement with the cable 50 so as to provide motion for the trolley 48.

Tool head 41 is oriented such that concrete distribution valve 49 (FIG. 5A) always leads relative to tool train movement along carrier 10. The ability to rotate tool head 41 on pivot 42*a* through 180° permits concrete deposition in with tool train 40 moving in either direction. Leveling auger 47 pushes excess concrete to the side of the predetermined path where concrete has not yet been deposited. Screed 45 is the trailing element. To maintain this orientation, the screed pivot frame 42 (FIG. 3) articulates 180 degrees about the screed pivot frame 42 at point 42*a* at the end of each traversal along the booms 20 and 22. The rotational direction of auger 47 changes as the direction of tool train 40 traversal changes, to cause discharge of excess concrete toward the subsurface where concrete has not yet been deposited.

Concrete is placed along the width of tool head 41 by the concrete distribution valve 49 (FIG. 5A). Excess concrete is leveled as needed by the auger 47 (FIG. 5A). The screed 45 (FIG. 5A) strikes off the concrete to final grade and consolidates the concrete with vibration. Signals from sensors 64, etc. can be used to control the location at which concrete is placed along the deposition front, as well as the rate of advance of the tool head 41, so as to avoid excessive or insufficient amounts of concrete along the deposition front. Signals from sensors 65, etc. control the elevation and operation of auger 47 and screed 45.

As the tool train 40 reaches an end of carrier 10 during the traversal thereof, machine 1, using wheels 91–94, is moved transversely to the predetermined path of tool train 41 to an adjacent position, away from the previously deposited concrete mass. In this adjacent position, tool head 41 should overlap by perhaps 10–30% the concrete deposited during the previous traverse. Tool head 41 is rotated 180° and a further traversal of tool train 40 in the opposite direction should be made before the previously deposited concrete sets up to an extent that prevents seamless combination with further adjacent deposits of concrete. This further traversal by tool train 40 deposits another strip or section of concrete that seamlessly mates and combines with the strip just previously deposited as well as with any excess concrete deposited in the current predetermined path during the just-previous traversal by tool train 40. This process continues until the entire concrete mass desired has been deposited.

Little or no waste of excess concrete occurs, since the excess during one traversal is placed by auger 47 directly in the path of the next traversal by tool train 40 and combines with concrete deposited in the new path.

Material Flow

Preferably, an independent concrete pump supplies concrete to the concrete delivery system 70 (FIG. 4A) at the inlet 78A of the concrete inlet pipe 78. The concrete passes through elements of concrete delivery system 70 and is ultimately discharged at selectable points along the concrete distribution valve 49 (FIG. 5A).

Alternative Embodiments

The system described here is large and complex. In a simplified embodiment, only tool head 41 is provided. Tool head 41 may be attached to any suitable boom or controllable frame and placed on any suitable carrier allowing tool head 41 to be carried or otherwise maneuvered along the edge of a concrete mass undergoing deposition. An external reference source permits accurate leveling and screeding in the same manner described for the machine of FIG. 1.

Simpler still, in either machine 1 or the simplified version, the screed 45 may be eliminated from tool head 41, and the screeding provided in any conventional manner. Since quite accurate leveling occurs with such a simplified tool head 41 having only a valve 49 and a leveling element such as auger 47 through the use of an external reference source, good results are possible here too. However, since the cost of including a screed 45 in a tool head 41 is quite small, I expect that most often a tool head 41 will include a screed 45 as well as leveling auger 47 and valve 49.

While leveling is shown as performed by auger 47, certainly other leveling devices may also be used. For example, a constantly moving chain carrying rake or crossbar elements can shift or discharge excess concrete to the side in the same way as done by auger 47.

I believe that other variations for the devices described are possible. Research and experimentation may allow even more useful and advantageous devices to be developed than the devices described above.

What I claim is:

1. A tool head for use in depositing and forming on a subsurface, a plastic mass of concrete, said tool head having a leading edge and a trailing edge, said tool head to be moved along a predetermined path, leading edge first and the trailing edge trailing, to create a predetermined upper surface geometry in the plastic mass of concrete, said plastic mass of concrete hardening over time to form a concrete slab, said tool head comprising:

a) a rigid tool head frame;

b) a concrete delivery unit rigidly attached to the tool head frame and forming at least a portion of the tool head's leading edge; and c) a leveling element rigidly attached to the tool head frame and forming at least a portion of the tool head's trailing edge, and discharging concrete substantially transversely to and outside the predetermined path.

2. The tool head of claim 1, wherein the leveling element comprises an auger.

3. The tool head of claim 2, wherein the auger has an axis substantially parallel to the leading and trailing edges.

4. The tool head of claim 1, including at least one sensor providing a signal indicating an excess or insufficiency of concrete along the deposition front, and wherein the concrete delivery unit is responsive to the sensor signal.

5. The tool head of claim 2, including a screed forming at least a portion of the trailing edge of the tool head and carried by the tool head frame.

6. The tool head of claim 1, wherein the concrete delivery unit is of the type that controllably deposits concrete at any point along a deposition front extending along the leading edge.

7. The tool head of claim 1, wherein the concrete delivery unit includes is a concrete valve controlling the location at which concrete is deposited across the deposition front.

8. A tool head for use in forming on a subsurface, a plastic mass of concrete, said tool head having a leading edge and a trailing edge, said tool head to be moved along a predetermined path, leading edge first, to create a predetermined upper surface geometry in the plastic mass of concrete, said plastic mass of concrete hardening over time to form a concrete slab, said tool head comprising:

a) a tool head frame; and b) a concrete delivery unit carried at least in part by the tool head frame, and comprising a concrete valve of the type having an outer tube and an inner tube mounted for rotation within the outer tube, said outer tube having a slot extending along at least a portion of the length thereof, and wherein the inner tube has a spiral slot extending along a length thereof, and a motor for controlling the angular position of the inner tube.

9. A tool head for use in forming on a subsurface, a plastic mass of concrete, said tool head having a leading edge and a trailing edge, said tool head to be moved along a predetermined path, leading edge first, to create a predetermined upper surface geometry in the plastic mass of concrete, said plastic mass of concrete hardening over time to form a concrete slab, said tool head comprising:

a) a tool head frame;

b) a concrete delivery unit carried at least in part by the tool head frame and forming at least a portion of the tool head's leading edge, said concrete delivery unit comprising a concrete valve of the type that deposits concrete at a controllable point along a deposition front extending along the leading edge;

c) a leveling element mounted on the tool head frame adjacent to the tool head's trailing edge; and d) at least one sensor providing a signal indicating an excess or insufficiency of concrete along the deposition front.

10. A carrier frame for supporting and controlling the movement of the tool head of claim 9, said carrier frame having a longitudinal axis and having means for supporting the tool head frame for translation along the longitudinal axis to thereby define the predetermined path, and with the concrete delivery unit, the screed, and the leveling element each spaced from the subsurface during such translation.

11. The carrier frame of claim 10, wherein the carrier frame includes at least one beam extending along the longitudinal axis, said beam including at least one telescoping section.

12. The carrier frame of claim 11, wherein the tool head includes an actuator assembly for controlling the elevation of the tool head.

13. The carrier frame of claim 12, including a plurality of steerable wheels supporting the carrier frame, and drive means for the wheels.

14. The carrier frame of claim 10, including a carrier section of a concrete delivery system, and wherein the tool head supports a tool head section of the concrete delivery system, said tool head section connected to receive concrete from the carrier section of the concrete delivery system and to deliver concrete to the concrete valve.

15. The carrier frame of claim 14, wherein the carrier section of the concrete delivery system comprises a flexible, horizontally deployed concrete hose.

16. The carrier frame of claim 15, wherein when in use the concrete hose has a generally U shape and is smoothly deployed, and wherein the carrier frame includes a retractor stretching the concrete hose, to thereby retain smoothness in the hose and the U shape thereof.

17. The carrier frame of claim 10, including a tool train traversing along the longitudinal axis, wherein the train has an arm having first and second ends, said arm projecting generally transversely from the carrier frame, and wherein the tool head is mounted on the first end of the tool train arm by a vertical pivot allowing for rotation of the tool head of at least 180°.

18. The carrier frame of claim 17, wherein the tool train includes first and second pivots attaching the tool train arm to the tool train, said first pivot having a horizontal axis and said second pivot having a vertical axis.

19. The carrier frame of claim 18, including means for supporting the tool train and for moving the tool train longitudinally along the carrier frame.

20. A tool head for use in forming on a subsurface, a plastic mass of concrete, said tool head having a leading edge and a trailing edge, said tool head to be moved along a predetermined path, leading edge first, to create a predetermined upper surface geometry in the plastic mass of concrete, said plastic mass of concrete hardening over time to form a concrete slab, said tool head comprising:

a) a tool head frame;

b) a concrete delivery unit carried at least in part by the tool head frame and forming at least a portion of the tool head's leading edge, said concrete delivery unit comprising a concrete valve of the type that deposits concrete at a controllable point along a deposition front extending along the leading edge; and c) an auger forming a leveling element mounted on the tool head frame adjacent to the tool head's trailing edge, and further including a tool head bracket, a support arm for attaching the frame to the tool head bracket, and an actuator for controlling the position of the frame relative to the tool head bracket.

21. The tool head of claim 20, including a sensor attached to the tool head frame for providing a signal indicating the elevation of at least one of the auger and the screed.

22. A tool head for use in forming on a subsurface, a plastic mass of concrete, said tool head having a leading edge and a trailing edge, said tool head to be moved along a predetermined path, leading edge first, to create a predetermined upper surface geometry in the plastic mass of concrete, said plastic mass of concrete hardening over time to form a concrete slab, said tool head comprising:

a) a tool head frame;

b) a concrete delivery unit carried at least in part by the tool head frame and forming at least a portion of the tool head's leading edge, said concrete delivery unit comprising a concrete valve of the type that deposits concrete at a controllable point along a deposition front extending along the leading edge; and c) an auger forming a leveling element mounted on the tool head frame adjacent to the tool head's trailing edge, and further including a tool head bracket, a support arm for attaching the frame to the tool head bracket, and an actuator for controlling the position of the frame relative to the tool head bracket.

23. The tool head of claim 22, including a sensor attached to the tool head frame for providing a signal indicating the elevation of the toolhead.

24. The tool head of claim 22, wherein the leveling element is of the type discharging concrete substantially transversely to and outside the predetermined path.

* * * * *